US011707121B2

(12) United States Patent
Dauchin

(10) Patent No.: US 11,707,121 B2
(45) Date of Patent: Jul. 25, 2023

(54) ITEM OF LUGGAGE

(71) Applicant: RIMOWA GmbH, Cologne (DE)

(72) Inventor: Benoît Gérad Marie Dauchin, Cologne (DE)

(73) Assignee: RIMOWA GmbH, Cologne (DE)

( * ) Notice: Subject to any disclaimer, the term of this patent is extended or adjusted under 35 U.S.C. 154(b) by 0 days.

(21) Appl. No.: 17/629,964

(22) PCT Filed: Jul. 23, 2020

(86) PCT No.: PCT/EP2020/070851
§ 371 (c)(1),
(2) Date: Jan. 25, 2022

(87) PCT Pub. No.: WO2021/018736
PCT Pub. Date: Feb. 4, 2021

(65) Prior Publication Data

US 2022/0248820 A1 Aug. 11, 2022

(30) Foreign Application Priority Data

Jul. 26, 2019 (DE) ..... 20 2019 104 125.0
Oct. 31, 2019 (EP) ..... 19206582

(51) Int. Cl.
*A45C 5/14* (2006.01)
*A45C 5/02* (2006.01)
(Continued)

(52) U.S. Cl.
CPC ..... *A45C 5/14* (2013.01); *A45C 5/02* (2013.01); *A45C 13/42* (2013.01); *A45C 2005/037* (2013.01)

(58) Field of Classification Search
USPC ..... 206/806; 190/111, 110
See application file for complete search history.

(56) References Cited

U.S. PATENT DOCUMENTS 5,685,451 A * 11/1997 Newby, Sr. ..... B29C 49/24 220/675
5,718,336 A * 2/1998 Haarlander ..... A45C 13/08 206/541
(Continued)

FOREIGN PATENT DOCUMENTS

CN 206994729 U 2/2018
DE 202019104125 U1 10/2019
(Continued)

OTHER PUBLICATIONS

International Preliminary Report on Patentability dated Oct. 25, 2021 of corresponding International Application No. PCT/EP2020/070851; 15 pgs.
(Continued)

*Primary Examiner* — Jennifer Robertson
*Assistant Examiner* — Justin Caudill
(74) *Attorney, Agent, or Firm* — Maier & Maier, PLLC

(57) ABSTRACT

An item of luggage, including: an upper side and a lower side, the lower side being provided with at least two luggage casters with which the item of luggage can be moved over a ground surface; at least two side surfaces and at least two main surfaces. A first three-dimensional pattern is arranged on at least one of the main and/or side surfaces and the first pattern has multiple first surface structures repeating in the first pattern, which protrude in relation to their respective main and/or side surface and/or are recessed in the same, is provided with a plate-type element on at least one main and/or side surface, the element being connected to the main and/or side surface by at least one connection.

16 Claims, 15 Drawing Sheets

(51) Int. Cl.
*A45C 13/42* (2006.01)
*A45C 5/03* (2006.01)

(56) References Cited

U.S. PATENT DOCUMENTS

| | | | | |
|---|---|---|---|---|
| 6,662,945 | B1 * | 12/2003 | Chang | H04B 1/086 455/344 |
| 7,641,048 | B1 * | 1/2010 | Shih | B25H 3/02 206/372 |
| 9,296,527 | B2 * | 3/2016 | Schweinberg | B29C 65/48 |
| 10,124,480 | B2 * | 11/2018 | Ou | B65D 25/205 |
| 2005/0067246 | A1 * | 3/2005 | Teicher | A45C 13/08 190/124 |
| 2005/0109650 | A1 * | 5/2005 | Huang | A45C 13/08 206/349 |
| 2016/0286912 | A1 * | 10/2016 | Morszeck | A45C 1/02 |
| 2017/0091500 | A1 * | 3/2017 | Reh | G06K 7/10366 |
| 2017/0318926 | A1 * | 11/2017 | Sijmons | A45C 5/02 |
| 2019/0080632 | A1 * | 3/2019 | Yu | A45C 5/03 |

FOREIGN PATENT DOCUMENTS

| | | | |
|---|---|---|---|
| EP | 1800560 | A1 | 6/2007 |
| JP | H0568606 | A | 3/1993 |
| KR | 20100137076 | A | 12/2010 |
| KR | 2012 0038703 | A | 4/2012 |
| TW | M 542 975 | U | 6/2017 |

OTHER PUBLICATIONS

International Search Report with English translation and Written Opinion dated Oct. 12, 2020 of corresponding International Application No. PCT/EP2020/070851; 17 pgs.

* cited by examiner

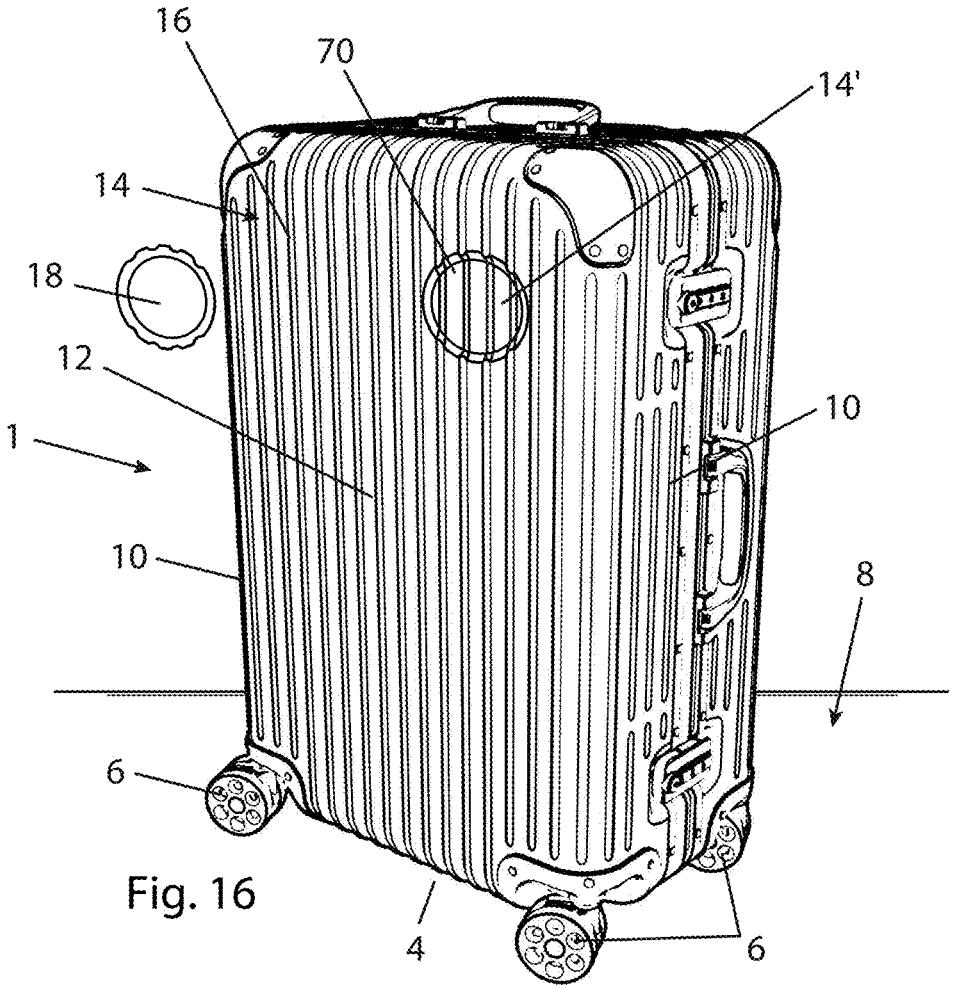
Fig. 16
Fig. 17
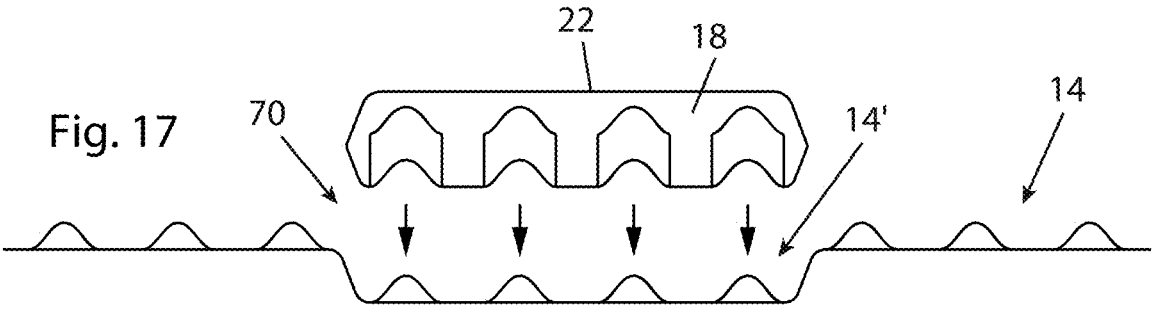
Fig. 18
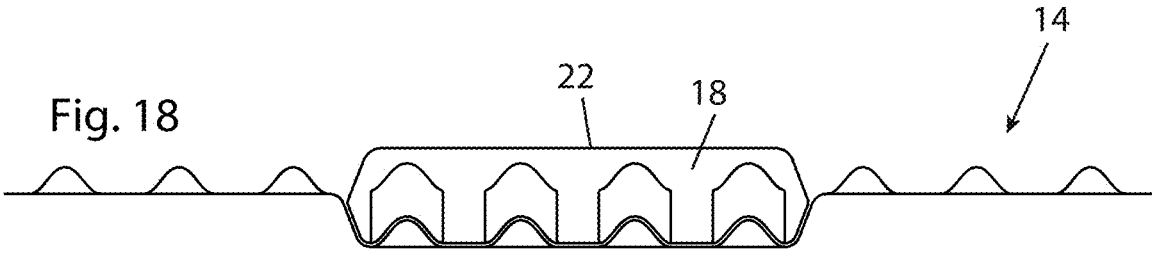

ITEM OF LUGGAGE

FIELD

The invention relates to an item of luggage as well as a plate-type element as well as a method for producing an upcycled item of luggage.

BACKGROUND

Items of luggage are known which comprise an upper and a lower side, wherein the lower side has arranged thereon two luggage casters with the aid of which the item of luggage can be moved on a ground surface. Further, a conventional item of luggage comprises at least two side surfaces and at least two main surfaces, wherein on at least one of the main and/or side surfaces a first three-dimensional pattern is arranged, wherein the first pattern comprises a plurality of surface structures repeating in the pattern, which surface structures protrude relative to the respective main and/or side surface and/or are recessed in the same. The aforementioned items of luggage are suitcases, in particular traveling suitcases, for example, which are essential items used during a trip, either vacation trips or business trips.

Generally, suitcases can be classified into soft shell cases and hard shell cases, wherein the latter have a higher form stability due to the hard outer shell. Hence, the items or the objects contained therein can be better protected against physical damage than in soft shell cases. Generally, hard shell cases are a high-quality alternative to the soft shell cases which are in most cases less expensive.

On many journeys, the items of luggage, in particular suitcases, are at least temporarily separated from the traveler. Thus, during rail journeys, suitcases and items of luggage are frequently stored on luggage racks, for example, which are located at the end of a railway car or in the middle of a railway car, for example. In the case of flights suitcases must frequently be checked in such that they can be stored in a luggage compartment of the airplane separate from the passenger area and transported. Upon arrival after the flight the suitcases are normally placed onto a luggage carousel where the airline passenger can collect his/her item of luggage.

For facilitating the recognition of one's own item of luggage, it is known to personalize the exterior of the item of luggage by means of labels, for example. A better alternative to labels made of plastic film is a so-called patch which normally is a textile patch. This type of personalization allows one's own item of luggage to be easily recognized among the numerous frequently similar looking items of luggage, for example suitcases in a luggage rack or on a luggage carousel. Patches can be sewn or glued to a flat surface.

High-quality items of luggage, such as in particular hard shell cases, which can have an outer shell of an aluminum alloy, for example, can be provided with three-dimensional patterns comprising a plurality of surface structures repeating in the pattern. The repeating surface structure can be a groove structure, for example, which is constituted by corrugations in the outer shell that are spaced from each other, extend in parallel to each other and are raised to the outside. The raised corrugations impart an uneven structure to the outer shell, i.e. the aforementioned groove structure. The groove structure does not allow patches, in particular textile patches, to be easily applied to the outer shell, in particular due to their thickness. It is frequently not possible to sew a patch to a hard shell. Furthermore, the patch would flatten with an increasing distance to the seam, which would result in an irregular shape of the patch. Further, it is also difficult to glue the patch over the entire surface to the grooved outer shell. Furthermore, the high-quality patch thus loses its flat shape, which has a negative effect on the appearance of the patch.

The latter applies to both patches and other identifying elements, such as labels made of a plastic film or metal fittings.

SUMMARY

It is an object of the present invention to provide an improved personalization and individualization of items of luggage, such as suitcases, for example, as compared to prior art. There is the problem that separate production lines must be established for producing individualized and personalized items of luggage.

It is thus an object to produce individualized items of luggage which can be produced in a simple manner.

Further, there is an increasing demand for upcycling existing items of luggage. Upcycling means that existing items of luggage are converted into new items of luggage. Older items of luggage are damaged at certain places, for example, or the surface is scratched. By upcycling the item of luggage new items of luggage can be produced without having to manufacture a completely new item of luggage. This is a resource-saving approach.

According to the invention, advantageously a plate-type element is arranged on at least one main and/or side surface and is connected to the main and/or side surface by at least one connecting means, wherein the plate-type element comprises at least one outer and one inner side, wherein a second pattern adapted to the pattern is provided on the inner side, wherein the second pattern comprises at least two three-dimensional surface structures which protrude relative to the inner side and/or are recessed in the same and are adapted to the first surface structures such that the second surface structures and the first surface structures engage with each other, wherein the plate-type element has a thickness which is thicker than the height and/or the depth of the second surface structures protruding relative to the inner side and/or recessed in the same.

The present invention offers the advantage that a plate-type element can be arranged on a main and/or side surface of the item of luggage and has such a geometry that the inner side of the plate-type element is exactly adapted to the first pattern of the pattern arranged on the main and/or side surface. In this manner, the plate-type element can be permanently and very well be arranged on the main and/or side surface. When the respective patterns are adapted to each other and the first and the second surface structures engage with each other, shifting on the main and/or side surface is avoided. This enhances the connection between the plate-type element and the main and/or side surface realized by the connecting means. In this manner, the main and/or side surface can be individualized and preferably reinforced.

By adapting the respective surface structures to each other, the plate-type element, when being applied to the main surface, can be prevented from shifting such that it is possible to exactly position the plate-type element. The inventive item of luggage offers the advantage that the luggage body with its upper side and lower side as well as its side surfaces and main surfaces can be produced separately from the plate-type element, and the plate-type element can be fastened to the main and/or to the side surfaces by the connecting means in a last step. This simplifies the production process. It is possible to always produce the same items of luggage. The plate-type elements can be manufactured on a second production line. The plate-type elements can be modified in an individual manner.

In this way, individualized items of luggage can be produced without increasing the production expenditure.

The plate-type element is a flat element configured as a carrier plate, for example, comprising two opposite sides which are broad or large relative to the thickness of the element. In the present invention, the two opposite sides are referred to as inner side and outer side, wherein the inner side of the plate-type element is preferably fastened to the main surface and/or side surface of the item of luggage. The plate-type element can be of a flat or a slightly curved configuration. The plate-type element is preferably made from a hard material. The material can comprise metal, stone or wood or a hard plastic material. According to another preferred embodiment, the plate-type element can comprise a plastic material, preferably PP, PA, PC or ABS. Alternatively, the plate-type element can comprise a metal alloy, preferably an aluminum alloy, a magnesium alloy or an alloy steel. The plate-type element can be integrally formed as a carrier plate. The inner and the outer side can have a round, a polygonal, a square, a hexagonal, a rectangular, an oval or any other shape.

For obtaining a particularly appealing optical configuration, the material of the plate-type element can be similar to the material of the main and/or side surfaces of the item of luggage, wherein the carrier plate configured as the plate-type element preferably comprises the same material as the grooved surface.

Preferably, the plate-type element is manufactured by a casting process, injection molding, stamping and/or pressing, milling, punching and/or 3D-printing process.

According to some preferred embodiments, the plate-type element can have an out-of-round shape and a longitudinal extension and a transverse extension perpendicular to the longitudinal extension in the plane defined by the plate-type element.

Here, the longitudinal extension and a longitudinal direction of the first three-dimensional surface structures, such as grooves, can be oriented in parallel to each other, or, alternatively, the longitudinal extension and the longitudinal direction of the grooves can include an angle ranging from larger than 0° to 90°. Here, the term "angle" is to be understood such that the smaller angle included between the longitudinal extension and the longitudinal direction corresponds to the "angle" irrespective of its sense of rotation. In particular, the angle can be determined by respectively projecting the longitudinal extension and the longitudinal direction onto a plane defined by the plate-type element. The angle is thus the angle that is included by the aforementioned projections.

The plate-type element can further be configured for receiving an accessory part. Preferably, the accessory part is a cell phone holder, a document holder, a bottle opener, a cup holder, a cigarette holder, an ashtray, an induction coil for induction charging of an accumulator of a mobile terminal, a power bank, an RFID transponder, an NFC transponder, a GPS tracker or a combination of the aforementioned embodiments.

According to another preferred embodiment, the accessory part is removably fastened to the plate-type element.

Further, it can be provided that the lowermost and the uppermost point, respectively, of the second three-dimensional surface structures are arranged such that they are lower and higher, respectively, by between 1 mm and 10 mm, preferably between 1 mm and 6 mm, in particular between 1 mm and 5 mm relative to the inner side. Further, it can advantageously be provided that the outer side of the plate-type element is of an essentially flat configuration. However, the outer side can also be of a slightly curved configuration.

The outer side of the plate type element can be produced in an individualized manner.

The outer side of the plate-type element can comprise a circumferential edge. Thus, even if additional outer layers are applied to the plate-type element, these outer layers can be protected by the circumferential edge.

The at least one connecting means can be at least one screw connection and/or clamp connection and/or rivet connection and/or weld connection preferably extending through at least one luggage wall comprising the main surface and/or side surface.

For permanently fastening the plate-type element configured as a carrier plate to the main and/or side surface and in the area of the three-dimensional surface structures, for example in the area of a grooved surface, at least one connecting means in the form of a fastening means for fastening the rear side as an inner side of the plate-type element to the grooved surface can be provided.

Preferably, a fastening means is a bore hole. This bore hole, in cooperation with a fastening element, for example a screw or a rivet, can allow for fastening the plate-type element to the surface structure or the main and/or side surface in a simple manner. The fastening element need merely be inserted into the bore hole or passed through the latter for establishing a known screw connection or rivet connection between the plate-type element and the surface structure. Preferably, the surface structure or the main and/or side surface also comprises a corresponding bore hole through which the fastening element passes. Preferably, the bore hole in the plate-type element is a though-going bore hole.

Alternatively, the bore hole in the plate-type element can be a blind bore hole open towards the rear side or the inner side. Thus, it is possible to pass e.g. a screw through a bore hole in the grooved surface and screw it into the blind bore hole on the inner side of the plate-type element, wherein the fastening means is not visible on the outer side of the plate-type element. For this purpose, the blind bore hole can comprise a thread. Alternatively, a self-tapping screw can be used which can be screwed into the blind bore hole without previously tapping a thread.

According to a preferred embodiment, a screw or a rivet can cooperate with the bore hole for fastening the plate-type element to the surface structure or the main and/or side surface.

When the bore hole has a round cross-section, the bore hole can particularly easily be produced by using a conventional round drill.

Alternatively, the bore hole can have a polygonal cross-section, particularly preferably a rectangular or hexagonal cross-section. Preferably, the cross-section of the bore hole corresponds to a shape of a boss of a round screw. For example, the bore hole can have a rectangular cross-section which corresponds to a square boss of a round-head screw as per DIN 603. Due to the polygonal shape of the bore hole, said bore hole can receive a torque which is effective when a nut is screwed onto the screw. Thus, a tool receiving portion need not be provided in the head of the screw, such as a round-head screw. On the one hand, this prevents an unauthorized person from removing the plate-type element from the surface from outside by inserting a tool into the tool receiving portion of the screw. Furthermore, the smooth surface of the screw head can be provided with a personalized label, for example the initials of the owner, a logo or a manufacturer's symbol.

Alternatively or additionally, the at least one connecting means can be at least one glued connection, in particular a layer of glue, preferably a sticky strip or a paste-like glue.

Further, a fastening means in the form of a magnet can be provided as the fastening means. This can in particular be advantageous when the first three-dimensional surface structure, for example the grooved surface, is at least partially made from a magnetic or magnetizable material, for example a ferritic metal or a ferritic metal alloy. Alternatively, a counterpart can be provided which at least partially comprises a magnetic or magnetizable material, for example a ferritic metal or a ferritic metal alloy. Here, the counterpart can be arranged on a side of the first three-dimensional surface structure, such as the groove surface, for example, opposite the plate-type element. The magnet of the plate-type element generates a magnetic attraction acting upon the counterpart such that the plate-type element is held in its position at the first three-dimensional surface structure due to the magnetic attraction. Alternatively, the plate-type element can comprise a magnetic or magnetizable material, for example a ferritic metal or a ferritic metal alloy, when the counterpart is configured as a magnet.

Further, it can be advantageous to configure a fastening means as a soldering point seat or a welding point seat. For fastening the carrier plate, said carrier plate can be soldered to the first three-dimensional surface structure at the soldering point seat or welded to the first three-dimensional surface at the welding point seat.

Alternatively or additionally, a fastening means can be a snap-in hook extending from the inner side. For fastening the plate-type element, the snap-in hook can be inserted through a corresponding bore hole in the first three-dimensional surface structure such that the snap-in hook snaps in place behind the bore hole and provides an undercut connection perpendicular to the extension of the plate-type element. It is also conceivable that a counterpart is provided on the rear side of the first three-dimensional surface structure and thus on the inner side of the item of luggage, wherein the snap-in hook creates an undercut connection with an area configured in the counterpart.

At least one seal can be arranged between the main and/or side surface and the plate-type element. This ensures that the connecting means, which can extend through the luggage wall, does not allow water or the like to enter.

The first and second surface structures of the first and the second pattern, respectively, can be ribs and/or grooves.

The ribs and/or grooves configured as three-dimensional surface structures of the first and the second pattern can be arranged in parallel to each other and preferably be arranged at a regular interval to each other.

At least three surface structures can be arranged on the inner side of the plate-type element.

By providing at least three surface structures, the plate-type element can be prevented from shifting on the main surface and/or side surface. The connection to the main and/or side surface is thus enhanced.

The second surface structures can comprise at least a number of first grooves and/or ribs extending in a first direction and a number of second grooves and/or ribs extending in a second direction different from the first direction, wherein both the first and the second ribs and/or grooves are adapted to the first surface structures, wherein either the first grooves and/or ribs or the second grooves and/or ribs engage with the first surface structures.

In this manner, the plate-type element can be applied to the main and/or side surface in different directions. The production process is thus further simplified.

The plate-type element can comprise at least one side surface which includes an angle relative to the outer side, said angle including more than 90°. The at least one side surface is the surface adjoining both the outer side and the inner side of the plate-type element and thus constitutes the side of the plate-type element.

In this manner, the connection between the plate-type element and the main and/or side surface can be further enhanced or rapid detachment can be avoided. Due to the angle of the side surface relative to the outer side of the plate-type element, impacts or forces acting upon the side surface of the plate-type element from outside can be well transferred.

Preferably, the side surface can be configured as a bevel.

Alternatively, the side surface can have an inwardly curved cross-section. In other words, the side surface has a concave shape. Thus, at the outer side of the plate-type element a particularly acute angle can be initially provided which causes solid bodies to be particularly effectively deflected upwards and hence away from the surface of the item of luggage.

At least one material, which comprises fabric, plastic material, leather and/or metal, can be applied to the outer side of the plate-type element.

In this manner, the plate-type elements can be further individualized since, in another production step, different materials can be applied to plate-type elements having the same geometry. In this manner, too, further individualizations can be realized in a simple production step.

The material can be glued to the outer side.

The material can be arranged in a recessed manner relative to circumferential edge.

In this manner, the material is prevented from rapidly detaching itself from the plate-type element.

For example, the plate-type element can serve as an identifying element for visual identification and personalization of an item of luggage, in particular a suitcase, comprising the identifying element. By providing the plate-type element as a carrier plate, the identifying element can be permanently and visibly attached.

According to a preferred embodiment, the outer side of the plate-type element is configured as a front side for receiving an identifying element in the form of a patch, in particular a textile patch.

Alternatively, the identifying element can be configured as an impressed and/or raised structure on the front side or the outer side of the plate-type element and/or in the form of a color application.

Preferably, the identifying element comprises a personalized or personalizing label in the form of a name or the initials of a person, a logo, a manufacturer's symbol, an address and/or in the form of GPS coordinates, for example. Preferably, the personalized label can be visibly applied to the patch and/or be readable information contained in a barcode, an RFID transponder or an NFC tag.

According to another preferred embodiment, the plate-type element comprises at its outer edge a rim extending in the circumferential direction and protruding from the outer side. On the one hand, the rim can define a size for a portion receiving the identifying element. Furthermore, the rim protects an identifying element in the receiving portion, in particular a patch, from wear. In addition, the rim can prevent pointed objects from entering the space between the identifying element and the outer side of the plate element and causing the identifying element to be peeled off.

According to another preferred embodiment, the patch can be fastened to the outer side of the plate-type element by at least one connecting means.

Preferably, the connecting means is provided in the form of a glue which is preferably applied at least partially across the surface between the outer side of the plate-type element and the rear side of the patch.

It has turned out to be particularly advantageous to provide a connecting means in the form of the fastening means or a fastening element interacting with the fastening means. In particular, a screw used for screwing the plate-type element to the first three-dimensional surface structure can also be used for fastening the patch to the plate-type element.

Preferably, the shape of the plate-type element is based on the shape of a patch to be received or mirrors the latter.

The main and/or side surfaces comprising the at least one first three-dimensional pattern can comprise at least one recessed area, wherein the plate-type element can be arranged in the recessed area on the main and/or side surface. The first pattern in the recessed area can differ from or be the same as the first pattern in the non-recessed area of the main and/or side surface. The recessed area of the main and/or side surface can be recessed such that the outer side of the plate-type element is arranged flush with the non-recessed area of the main and/or side surface.

The arrangement of the plate-type element in the recessed area of the main and/or side surfaces offers the advantage that the plate-type element does not easily detached itself from the main and/or side surfaces. It is better protected against lateral application of force.

A plate-type element according to any one of claims 1-15 is provided which comprises at least one outer and one inner side, wherein the second pattern is provided on the inner side, wherein the second pattern comprises the at least two three-dimensional surface structures which protrude relative to the inner side and/or are recessed in the same, wherein the plate-type element has a thickness which is thicker than the height and/or the depth of the second surface structures arranged in a protruding and/or recessed manner relative to the inner side, wherein the second pattern is adapted to the first pattern produced on the main and/or side surface according to any one of claims 1-15.

Further, according to the present invention, a method for producing an upcycled item of luggage having a modified main and/or side surface is provided, comprising the following steps:

providing a first existing item of luggage having at least two side surfaces and at least two main surfaces, wherein a first three-dimensional pattern is arranged on at least one of the main and/or side surfaces, wherein the first pattern comprises a plurality of first surface structures repeating in the first pattern, which surface structures protrude relative to the respective main and/or side surface and/or are recessed in the same, producing and/or providing a plate-type element, wherein the plate-type element comprises at least one outer and one inner side, wherein a second pattern adapted to the first pattern of the first existing item of luggage and having at least two three-dimensional surface structures is provided on the inner side, which surface structures protrude relative to the inner side and/or are recessed in the same and are adapted to the first surface structures, wherein the plate-type element has a thickness which is thicker than the height and/or the depth of the second surface structures protruding or recessed relative to the inner side, permanent fastening of the plate-type element to a main and/or side surface of an existing item of luggage such that the second surface structures engage with the first surface structures.

According to the present application, existing items of luggage are understood as an item of luggage which is not necessarily covered by claims 1-15. This existing item of luggage may merely comprise at least two side surfaces and at least two main surfaces as well as an upper side and a lower side. This existing item of luggage need not necessarily comprise a plate-type element on the main and/or side surface as described in claims 1-15. However, the existing item of luggage may already comprise one or a plurality of plate-type elements on the main and/or side surface and another plate-type element can additionally be provided on the main and/or side surface for producing the upcycled item of luggage.

Upcycled means that a new object is produced from an existing object by modification or addition of individual elements.

In the present case, a new item of luggage having modified side and/or main surfaces is produced.

Hereunder the invention will be explained on the basis of exemplary embodiments.

DETAILED DESCRIPTION

Figure 1:
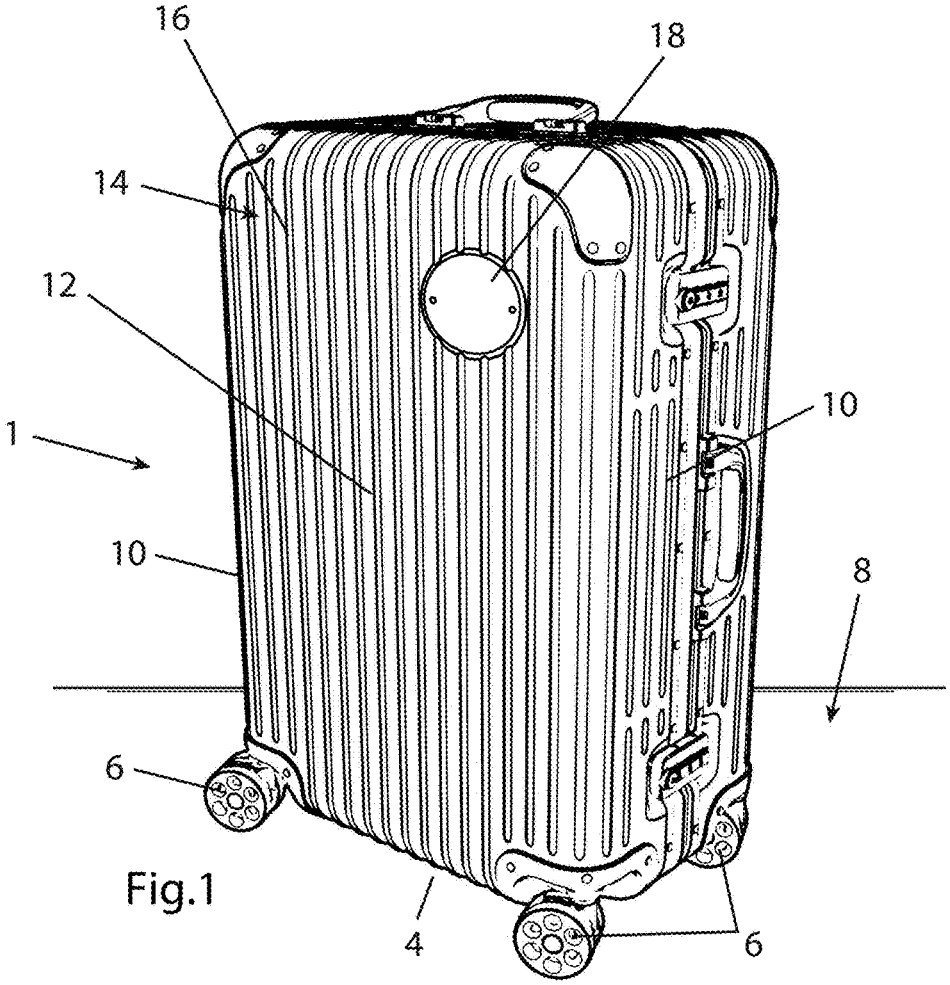
FIG. 1 schematically shows an item of luggage according to the present invention, FIG. 2 schematically shows a top view of a section of the main surfaces of the item of luggage of FIG. 1, FIG. 3 schematically shows a plate-type element, FIG. 4 schematically shows the inner side of the plate-shaped element, FIG. 5 schematically shows the side view of the plate-type element of FIGS. 3 and 4, FIG. 6 schematically shows a section of the connection between the plate-type element and the luggage wall, FIG. 7 schematically shows the inner side of another exemplary embodiment of a plate-type element, FIG. 8 schematically shows a side view of another exemplary embodiment of a plate-type element, FIG. 9 schematically shows a method for producing an upcycled item of luggage, FIG. 10 schematically shows another exemplary embodiment of a plate-type element, FIG. 10*a* schematically shows another exemplary embodiment of a plate-type element, FIG. 11 schematically shows another exemplary embodiment of a plate-type element, FIG. 11 a schematically shows another exemplary embodiment of a plate-type element, FIG. 12 schematically shows another exemplary embodiment of a plate-type element, FIG. 12*a* schematically shows another exemplary embodiment of a plate-type element, FIG. 13 schematically shows another exemplary embodiment of a plate-type element, FIG. 13*a* schematically shows another exemplary embodiment of a plate-type element, FIG. 14*a* schematically shows an embodiment of a connecting means, FIG. 14*b* schematically shows an embodiment of a connecting means, FIG. 14*c* schematically shows an embodiment of a connecting means, FIG. 15*a* schematically shows another exemplary embodiment of another connecting means, FIG. 15*b* schematically shows another exemplary embodiment of another connecting means, FIG. 15*c* schematically shows another exemplary embodiment of another connecting means, FIG. 15*d* schematically shows another exemplary embodiment of another connecting means, FIG. 16 schematically shows another exemplary embodiment, FIG. 17 schematically shows a side view of the exemplary embodiment of FIG. 16, FIG. 18 schematically shows the exemplary embodiment of FIG. 17 in the assembled condition, FIG. 19A schematically shows another exemplary embodiment of a plate-type element, FIG. 19B schematically shows another exemplary embodiment of a plate-type element, FIG. 19C schematically shows another exemplary embodiment of a plate-type element, FIG. 20A schematically shows another exemplary embodiment of a plate-type element, FIG. 20B schematically shows another exemplary embodiment of a plate-type element, FIG. 21 schematically shows the exemplary embodiment of the plate-type element of FIGS. 19A-C arranged on an item of luggage, FIG. 22 schematically shows the exemplary embodiment of the plate-type element of FIGS. 19A-C arranged on an item of luggage, wherein a patch is fastened to the plate-type element.

FIG. 1 shows an item of luggage 1 according to the invention. The item of luggage 1 comprises an upper 2 and a lower side 4. At least two luggage casters 6 are arranged on the lower side 4, wherein, in the present case, the item of luggage 1 comprises four luggage casters 6. The item of luggage 1 can be moved on a ground surface 8 with the aid of the luggage casters 6. The item of luggage 1 further comprises at least two side surfaces 10 and at least two main surfaces 12. Preferably, the main surfaces can be larger than the side surfaces 10 with respect to the surface area. However, this is not absolutely necessary. The side surfaces 10 and the main surfaces 12 can have the same size with respect to the surface area.

At least one first three-dimensional pattern 14 is arranged on at least one of the main and/or the side surface 12, 10. The first three-dimensional pattern 14 can be arranged on both the main and the side surfaces 12, 10. The first pattern 14 can comprise a plurality of first surface structures 16 repeating in the pattern and protruding relative to the first main and/or side surface 10, 12 and/or recessed in the same. This is shown in more detail in FIG. 2.

Figure 2:
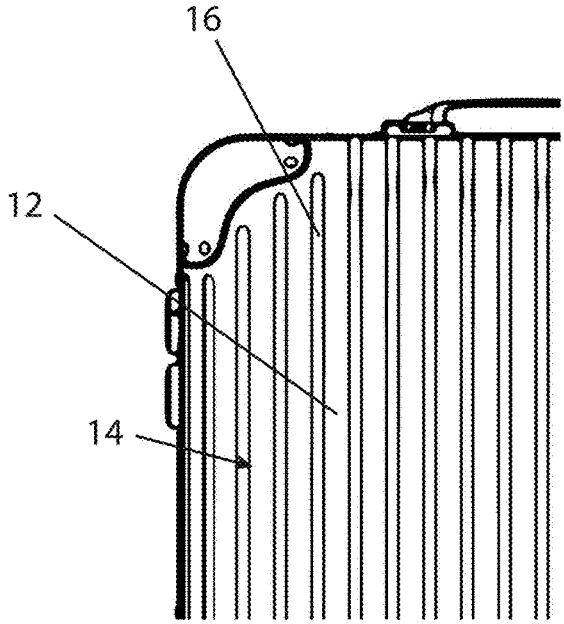

FIG. 2 illustrates a section of the first pattern 14 of the main surfaces 12. It shows that the first pattern 14 comprises first surface structures 16 repeating in the pattern 14, which surface structures, in the present case, protrude relative to the main surface 12. In the present case, these first surface structures 16 are ribs protruding relative to the main surface 12. These ribs are arranged at a regular distance to each other.

FIG. 1 further illustrates at least one plate-type element 18. In the illustrated exemplary embodiment, the plate-type element 18 is arranged on a main surface 12. The plate-type element 18 is connected to the main surface 12 via at least one merely schematically illustrated connecting means 20. However, additionally or alternatively, plate-type elements 18 can be applied to the side surfaces 10.

Figure 3:
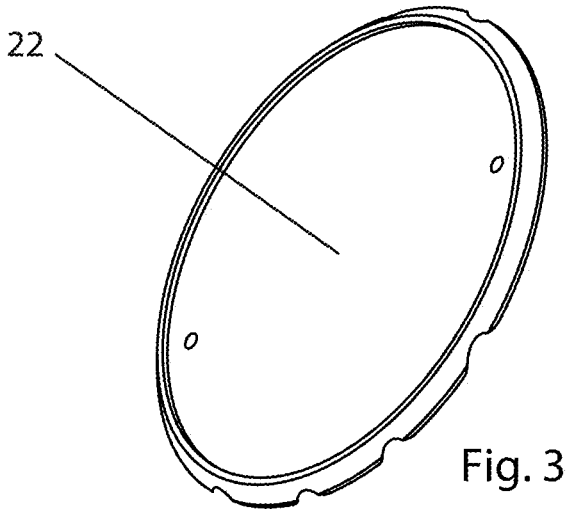
Figure 4:
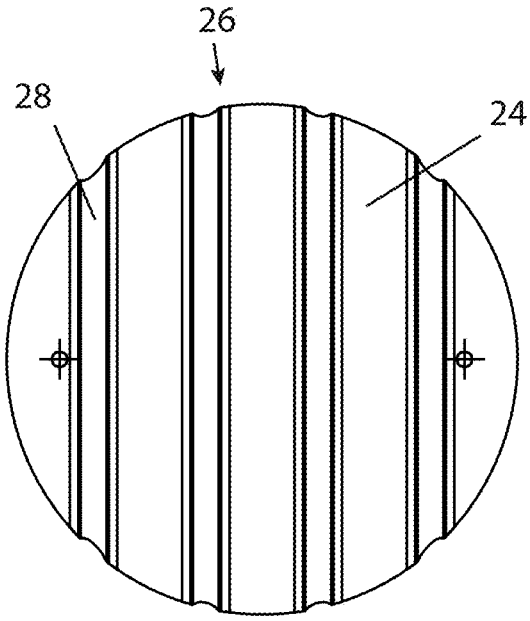
Figure 5:
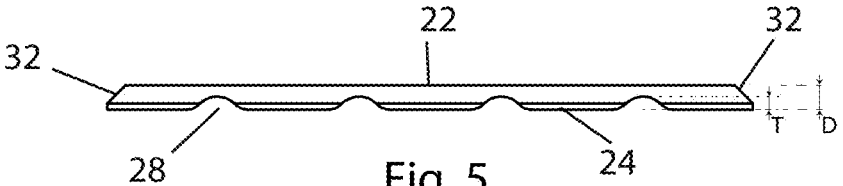

FIGS. 3-5 illustrate an exemplary embodiment of a plate-type element 18. FIG. 3 illustrates the outer side 22 of the plate-type element 18. In the illustrated exemplary embodiment, the outer side 22 of the plate-type element 18 has a round shape. However, the shape can be selected as desired. It can also be square, rectangular, oval or be any other shape. The illustrated outer side 22 is the side that faces away from the item of luggage when the plate-type element 18 is connected to the main and/or side surface of the item of luggage 1. The illustrated outer side 22 has a flat surface. Further, FIG. 3 shows that the outer side 22 comprises a circumferential edge. Thus, another material layer can be applied to the outer side, which material layer is protected by the outer edge.

FIG. 4 illustrates the inner side of the plate-type element. A second pattern 26 adapted to the first pattern 14 is provided on the inner side 24. The second pattern 26 comprises at least two second three-dimensional surface structures 28 which are recessed relative to the inner side 24. The second three-dimensional surface structures 28 are adapted to the first surface structures 16 such that the second surface structures 28 and the first surface structures 26 engage with each other. In the illustrated embodiment, the second surface structures 28 are grooves adapted to the shape of the ribs of the first pattern 14. In the assembled condition, the ribs of the first pattern 14 engage with the grooves of the second pattern 26.

As is shown in FIG. 5, the plate-type element 18 has a thickness D which is thicker than the depth T of the second surface structure 26 recessed relative to the inner side 24. The second surface structures 26 configured as grooves have a depth T which is smaller than the thickness of D of the plate-type element 18. The depth T is determined such that it is the distance between the lowermost one of the second three-dimensional surface structures and the inner side. Preferably, the depth T ranges between 1 mm and 10 mm, preferably between 1 mm and 6 mm, in particular between 1 mm and 5 mm.

On the other hand, the first surface structures 16 of the first pattern 14 can also be recessed relative to the main and/or side surface. They can be grooves, for example. In this case, the second surface structures 28 of the second pattern 26 would be raised or protrude relative to the inner side of the plate-type element 18, and in this case, the second surface structures 28 would engage with the first surface structures 16. Preferably, the height of the second surface structures is smaller than the thickness D of the plate-type element 18. The height of the second surface structures is defined such that it is the distance between the highest point of the second three-dimensional surface structures and the inner side of the plate-type element. Preferably, the height ranges between 1 mm and 10 mm, preferably between 1 mm and 6 mm, in particular between 1 mm and 5 mm.

The first three-dimensional surface structures 16 and also the second three-dimensional surface structures 28 can have a shape differing from that of a rib or a groove. However, the rib or groove shape oriented in parallel to the longitudinal edges offers the advantage that the plate-type elements can be easily aligned with respect to this edge.

FIG. 5 further shows a plate-type element 18 where the side surfaces 32 of the plate-type element include an angle relative to the outer side 22 which is larger than 90 degrees.

This means that the plate-type element, in its assembled condition, is configured such that the side surfaces 32 of the plate-type element are transversely arranged relative to the main and/or side surface 12, 10 of the item of luggage 1. In this manner, the plate-type element 18 cannot be easily detached from the side and/or main surface 10, 12 of the item of luggage 1 since impacts and/or forces acting upon the side surfaces 32 of the plate-type element 18 are transferred due to the transverse configuration of the side surfaces 32. The transverse configuration causes a portion of the forces laterally acting upon the side surfaces 32 of the plate-type element 18 to be transferred towards the item of luggage 1. In this manner, the portion of the lateral forces provoking detachment of the plate-type element 18 can be reduced.

Figure 6:
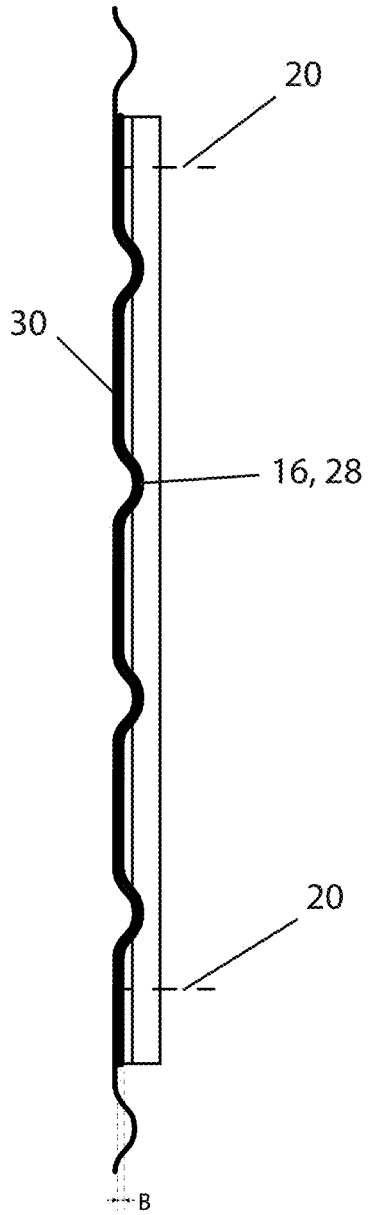

FIG. 6 shows a side view of the connection between the item of luggage 1 and the plate-type element 18. The plate-type element 18 is arranged on one of the main surfaces 12 of the item of luggage 1. The plate-type element is connected to the main surface of the item of luggage 1 via connecting means 20. The connecting means are merely schematically illustrated as dashes. The connecting means 20 can extend through the plate-type element 18 and through the luggage wall of the item of luggage 1 comprising the respective main and/or side surface. The connecting means 20 can be a rivet, clamp, screw or weld connection. Exemplary connecting means 20 are illustrated in FIG. 14.

For example, four connecting means 20 can be provided in a plate-type element 18, which connecting means, in the case of a rectangular plate-type element, are arranged in the respective corners, for example.

FIG. 6 shows that a seal 30 is provided between the plate-type element 18 and the main surface 12. Thus, it can be ensured that the plate-type element 18 is connected to the main surface 12 in an air-tight manner. Further, a seal can be provided only around the respective connecting means 20, or there may be no seal at all. The seal can have a thickness B ranging between 0.3 mm and 3 mm.

Figure 7:
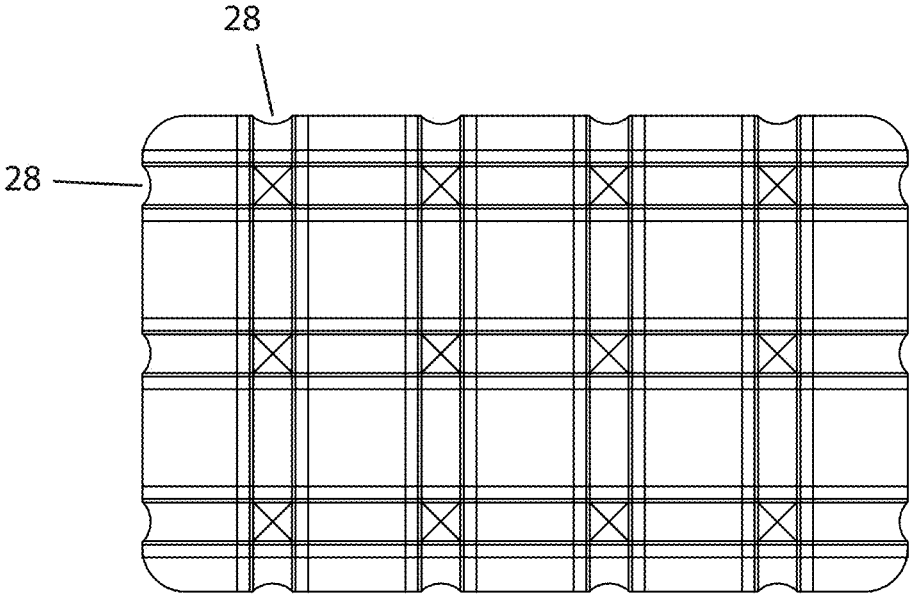

FIG. 7 illustrates the inner side of another alternative plate-type element 18. FIG. 7 shows that the second pattern 26 comprises two different second three-dimensional surface structures 28. These different second surface structures 28 are configures as ribs or grooves, wherein at least a number of first grooves and/or ribs 28 extend in a first direction and a number of second grooves and/or ribs 28 extend in a second direction different from the first direction. Both the first and the second grooves and/or ribs are adapted to the first surface structure 16. The plate-type element 18 can now be arranged, with the first grooves and/or ribs or the second grooves and/or ribs, on the main and/or side surface 10, 12 such that the first grooves and/or ribs or the second grooves and/or ribs engage with the first surface structures. Thus, a plate-type element 18 can be produced which is arranged on the main and/or side surface 10, 12 in different directions.

Figure 8:
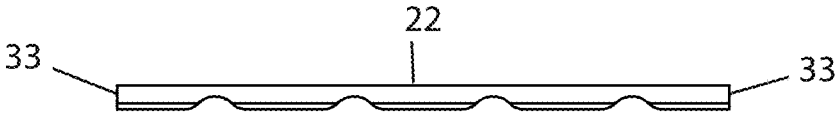

FIG. 8 illustrates another alternative exemplary embodiment. It shows a plate-type element 18 where the side surfaces 32 of the plate-type element include an angle of 90° relative to the outer side 22.

Figure 9:
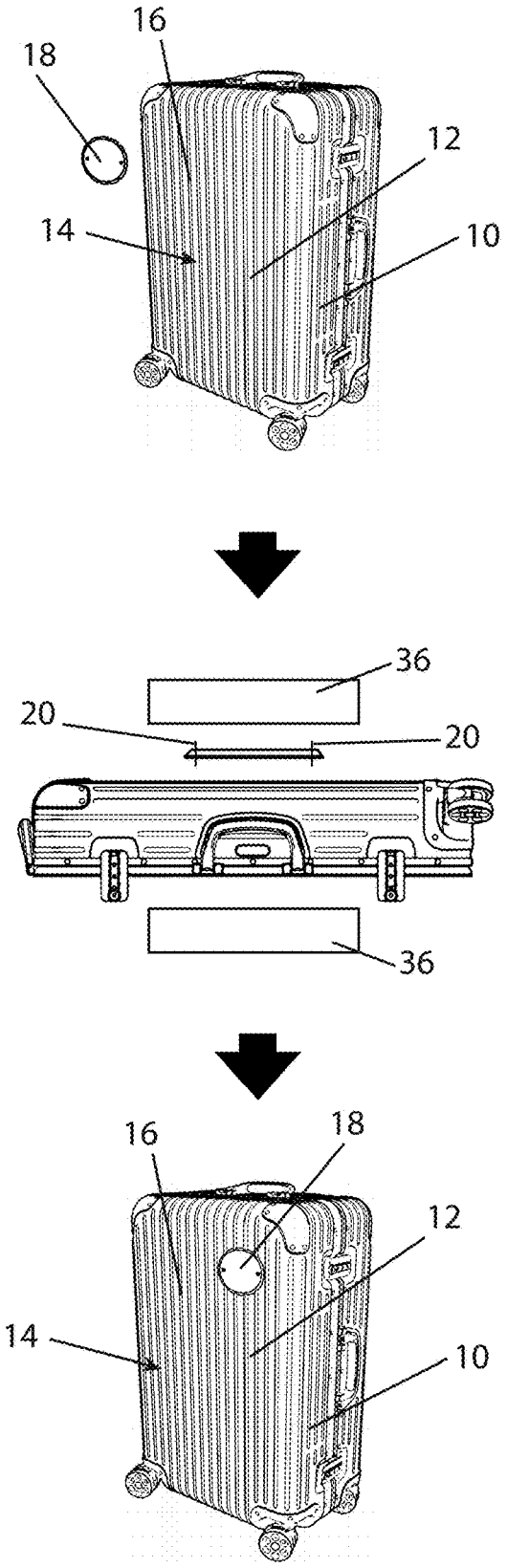
Figure 10:
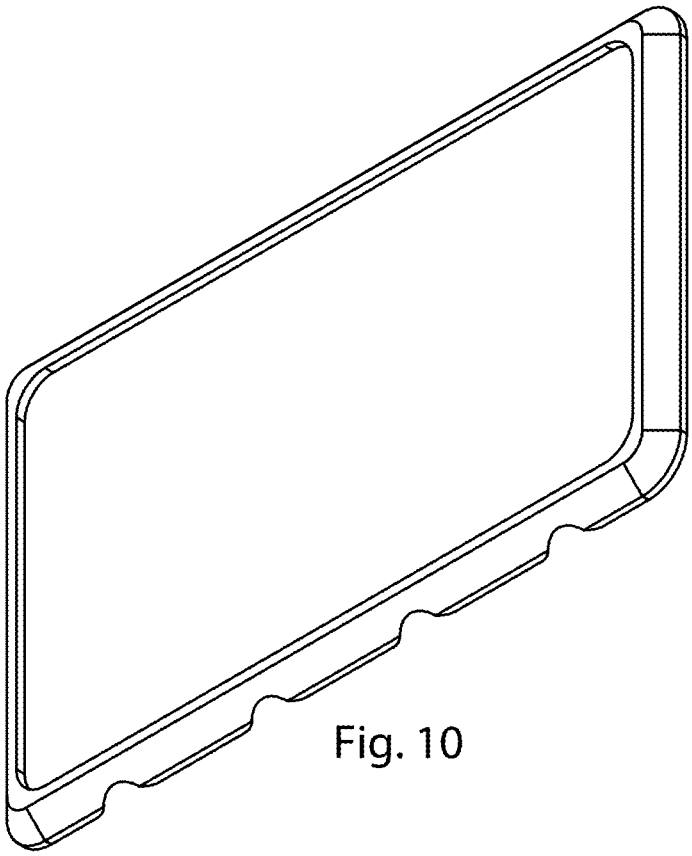
Figure 10A:
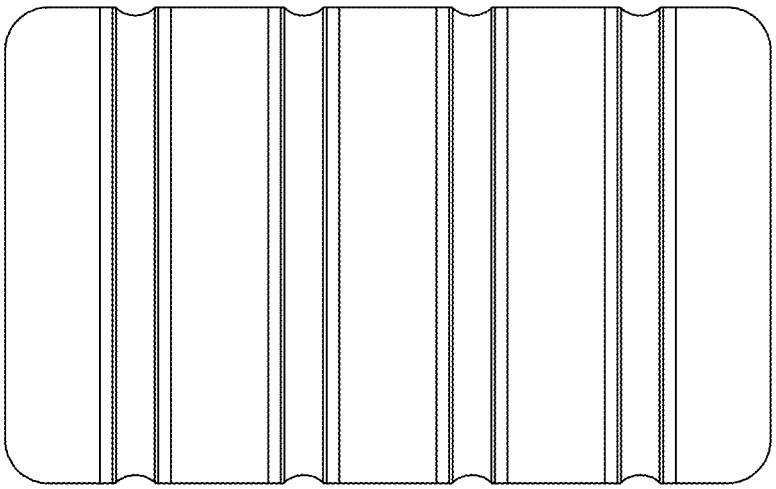
Figure 11:
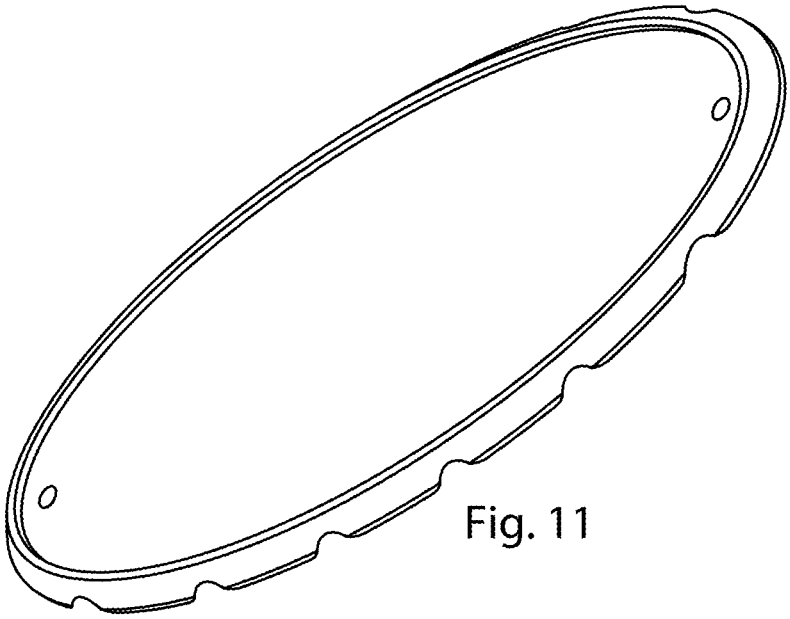
Figure 11A:
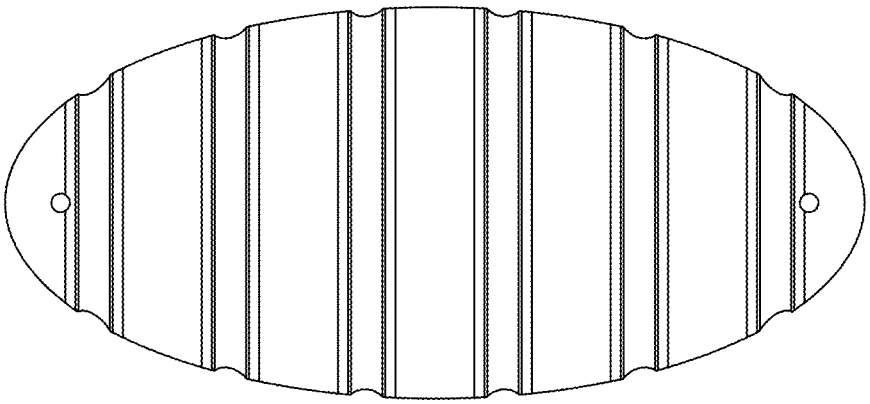
Figure 12:
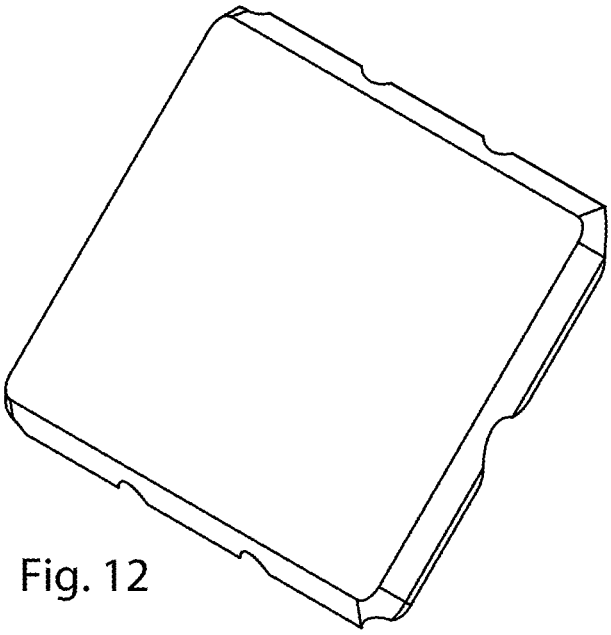
Figure 12A:
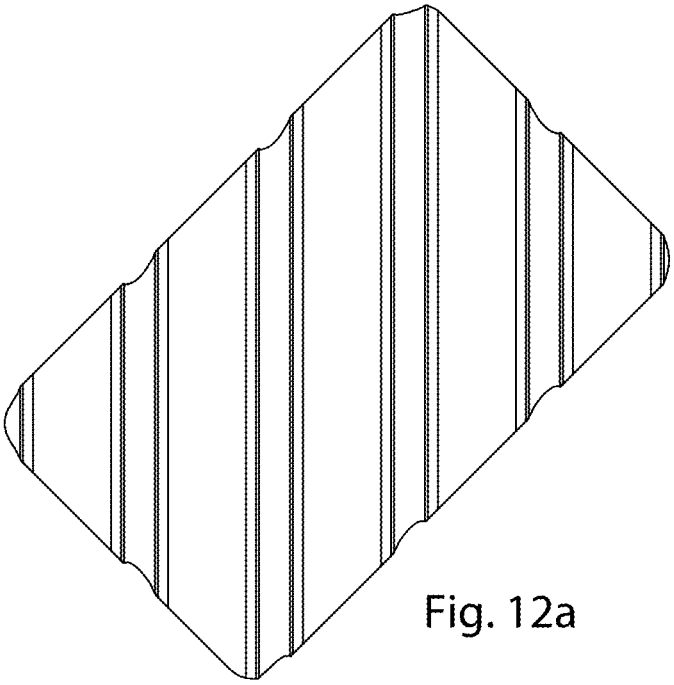
Figure 13:
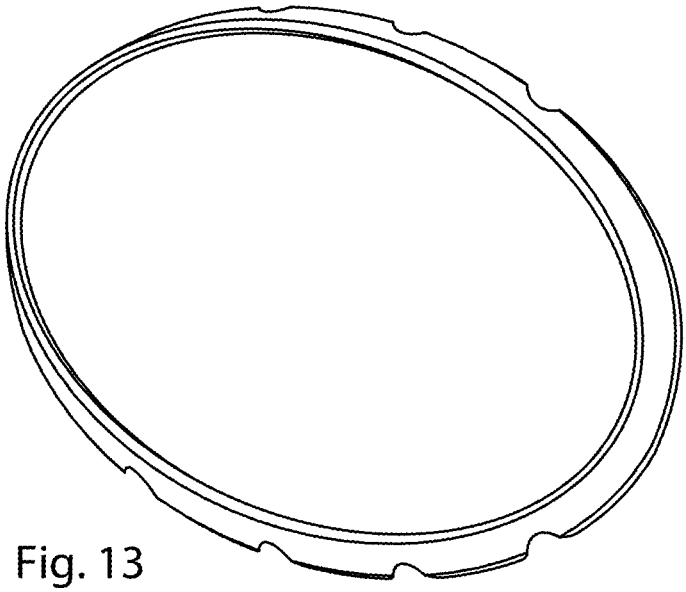
Figure 13A:
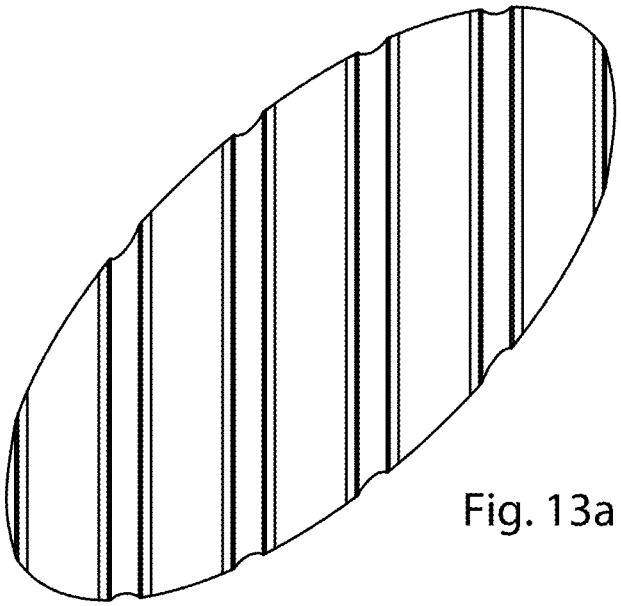

FIG. 9 exemplarily shows various steps of a method for producing an item of luggage 1 according to claim 1 or an upcycled item of luggage 1 having a modified main or side surface. An item of luggage or an existing item of luggage 11 having at least two side surfaces 10 and at least two main surfaces 12 is provided, wherein a first three-dimensional pattern 14 is arranged on at least one of the main and/or side surfaces 12, 10, wherein the first pattern 14 comprises a plurality of first surface structures 16 repeating in the pattern, which surface structures protrude relative to the respective main and/or side surfaces 10, 12 and/or are recessed in the same.

In the second step, a plate-type element 18 is produced and/or provided, wherein the plate-type element 18 comprises at least one outer side 22 and one inner side 24, wherein on the inner side a second pattern 26 adapted to the first pattern 14 of the item of luggage 1 or the existing item of luggage 11 and at least two three-dimensional surface structures 28 are provided which protrude relative to the inner side 24 and/or are recessed in the same and are adapted to the first surface structure, wherein the plate-type element 18 has a thickness which is thicker than the height and/or the depth of the second surface structures 28 that protrude relative to the inner side 24 or are recessed in the same.

The plate-type element can be made from metal. It can be cast or formed from a metal sheet. Alternatively, the plate-type element can be made from a plastic material. It can be produced by injection molding, for example. In another step, the plate-type element 18 is preferably permanently connected or permanently fastened to the item of luggage 1 or the existing item of luggage 11 with the aid of a device 36 and with the aid of connecting means 20. Here, the plate-type element 18 is placed onto the main and/or side surface, and holes are preferably drilled into the luggage wall comprising the main and/or side surface with the aid of the device 36. Subsequently, the plate-type element 18 is connected to the item of luggage or the existing item of luggage 11 with the aid of connecting means 20.

Alternatively, when e.g. a rivet connection is used as the connecting means 20, the rivets can be directly driven through the luggage wall comprising the main and/or side surface and thus be connected.

As described, a new item of luggage 1 according to claims 1 to 15 can be produced which comprises modified main and/or side surfaces as compared to the existing item of luggage 11. In this manner, damage, dents or scratches on an existing item of luggage can be removed. Various embodiments of the connecting means are illustrated in FIG. 14.

FIGS. 10-13*a* show different configurations of a plate-type element. The outer surfaces can have different shapes. The surface structures can be aligned relative to the outer edges in various ways.

Figure 14A:
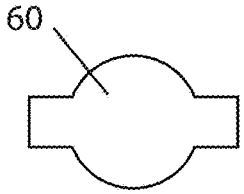
Figure 14B:
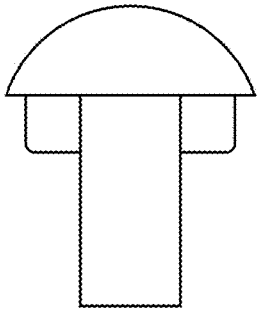
Figure 14C:
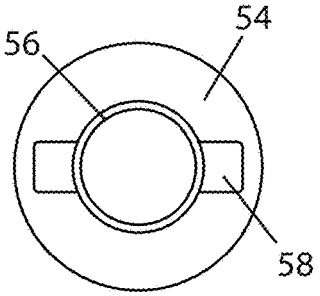
Figure 15A:
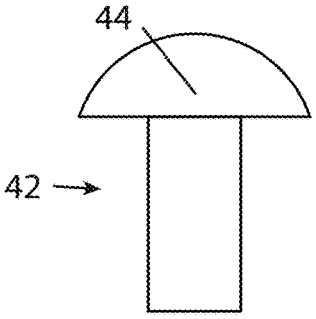
Figure 15B:
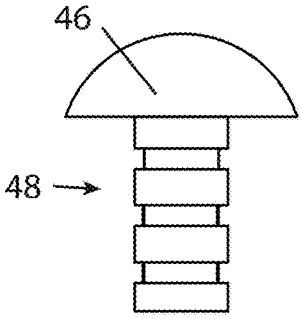
Figure 15C:
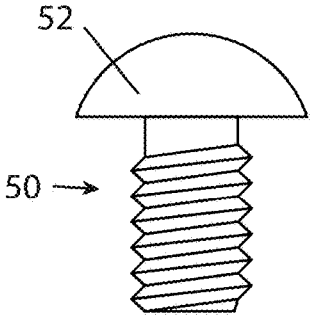
Figure 15D:
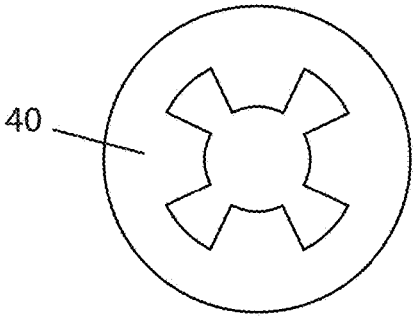

FIGS. 14*a*-*c* show an exemplary embodiment of a connecting means. The illustrated connecting means 54 is a screw connection. The illustrated upper portion of the connecting means 54 is configured as a rivet, the difference being, however, that an internal thread is provided in the lower portion 56 of the rivet. The lower portion 56 of the connecting means 54 can be inserted through the plate-type element 18 and the luggage wall comprising the main and/or side surface. On the opposite side of the luggage wall a screw can be screwed into the thread and connect the connecting means 54 to the item of luggage. The connecting means 54 further comprises wings 58 on the head via which the connecting means 54 can be fastened in a rotation-preventing manner. For this purpose, a hole 60 having the shape illustrated in FIG. 14*a* must be provided in the plate-type element 18 and/or in the luggage wall comprising the main and/or side surface.

FIGS. 15*a*-*d* illustrate further exemplary embodiments of connecting means with the aid of which the plate-type element 18 and the item of luggage 1 can be connected. The illustrated connecting means are clamp connections. The connecting elements 42, 48, 50 of the connecting means are fitted through the plate-type element 18 and the luggage wall comprising the main and/or side wall. On the opposite side of the luggage wall the clamp disk 40 is provided which can be slid onto the connecting elements 42, 48 and 50 and fix the connecting elements 42, 48, 50 to the luggage wall. For this purpose, according to the exemplary embodiment of FIG. 15*a*, the clamp disk 40 bores its way into the connecting element 42. In the exemplary embodiment of FIG. 15*a*, the interior portion of the clamp disk presses into the grooves provided in the connecting element 48, and in the exemplary embodiment of FIG. 15*c*, the interior portion of the clamp disk 40 presses into the thread turns of the thread provided on the connecting element 52. The connecting elements 42, 48, 50 are also configured as a rivet having rivet heads 44, 46, 52.

FIG. 16 shows an exemplary embodiment where the main and/or side surfaces comprising at least one first three-dimensional pattern include a recessed area 70. The plate-type element 18 can be arranged in the recessed area 70 on the main and/or side surface. The first pattern 14' in the recessed area 70 can be different from or be the same as the first pattern 14 in the non-recessed area of the main and/or side surface 12, 10. The recessed area 70 of the main and/or side surface 12, 10 can be recessed such that the outer side of the plate-type element 18 can be flush with the non-recessed area of the main and/or side surface 10, 12.

FIGS. 17 and 18 illustrate how the plate-type element 18 is arranged in the recessed area 70. In the exemplary embodiment illustrated in FIG. 18, the plate-type element 18 is arranged in a recess, however, the recessed area 70 is not recessed to such an extent that the outer side 22 is flush with the non-recessed area of the main and/or side surface 10, 12.

The arrangement of the plate-type element 18 in the recessed area 70 of the main and/or side surfaces 12, 10 offers the advantage that the plate-type element 18 does not easily detach itself from the main and/or side surface 12, 10. It is better protected against lateral application of force.

Figure 19B:
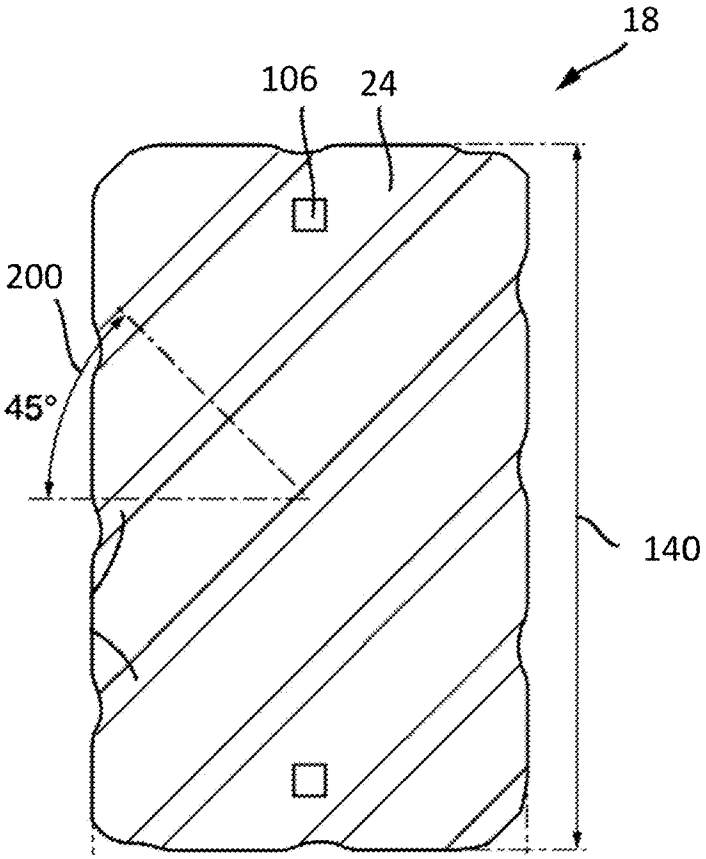
Figure 19C:
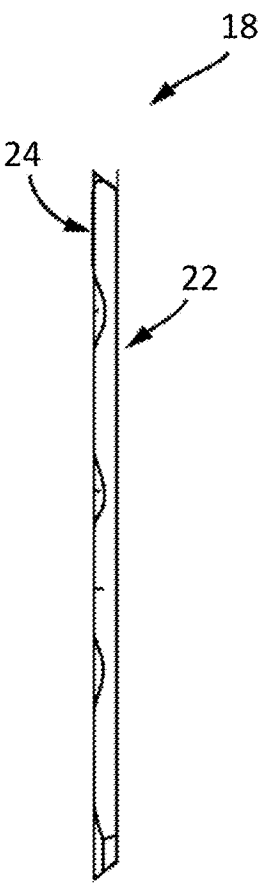
Figure 19A:
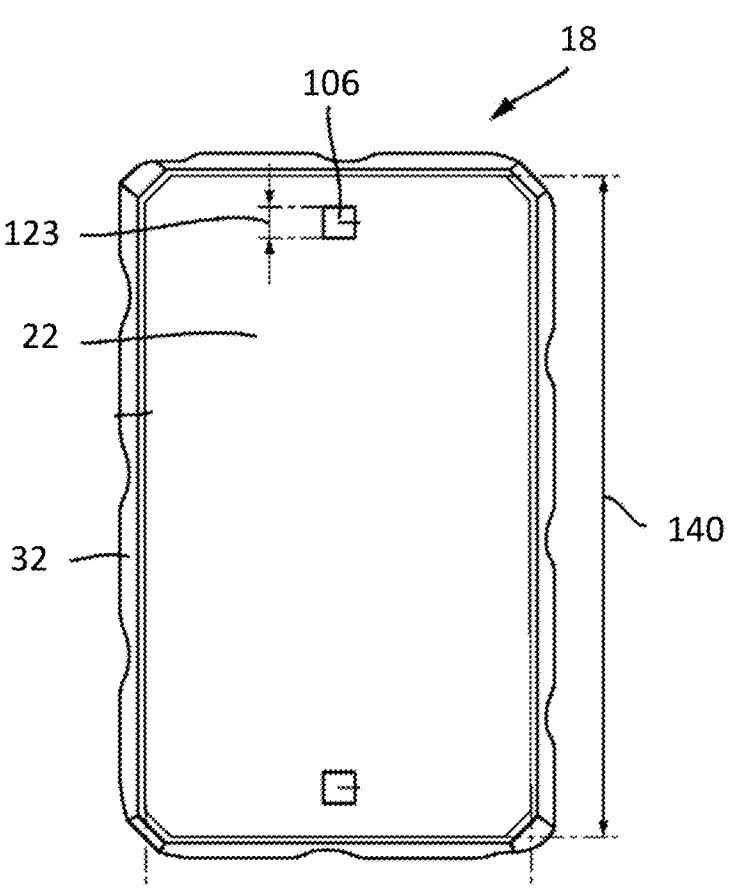

FIGS. 19A to 19C schematically show different views of a plate-type element 18 according to another embodiment. Here, FIG. 19A schematically shows an outer side of the plate-type element 18, FIG. 19C schematically shows a side view of the plate-type element 18, and FIG. 19B schematically shows a view of the inner side of the plate-type element 18.

The plate-type element 18 essentially corresponds to that of FIGS. 10 and 10A, and 12 and 12A, respectively, wherein the side surfaces 32 have an inclined portion in the form of a bevel.

Further, the through-going bore holes 106, which are the fastening means, have a square shape, wherein the side length 123 of the square through-going bore holes 106 is configured correspondent to a square boss of a round-head screw which serves as a fastening element for fastening the plate-type element to the item of luggage.

Figure 20A:
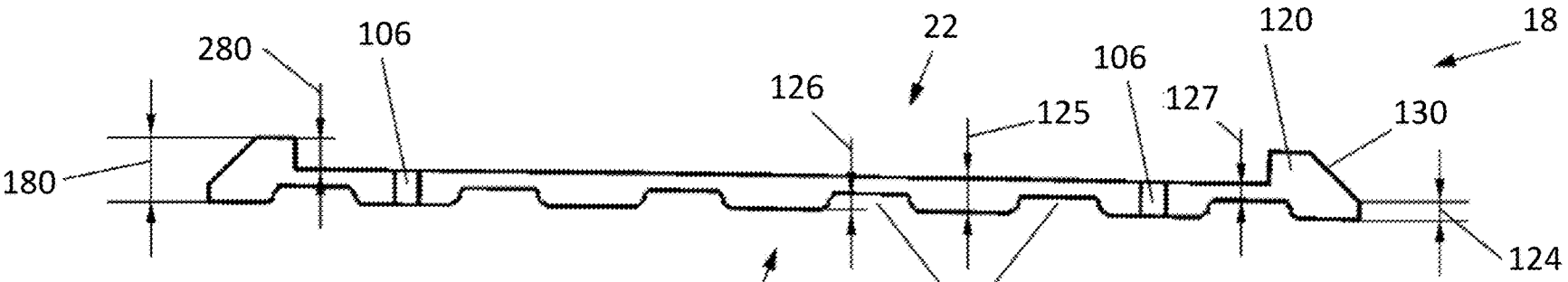

FIG. 20A schematically shows a sectional view of a plate-type element 18 according to another embodiment. The plate-type element 18 essentially corresponds to that of FIGS. 19A to 19C, wherein the inclined portion 130 configured as a bevel does not extend up to the inner side 24 but starts from a predefined rim distance 124 relative to the inner side 24.

FIG. 20A further shows that the plate-type element 18 has a basic thickness 125. The recesses 111 which constitute the three-dimensional surface structure have a depth 126 which is smaller than the basic thickness 125 such that the plate-type element 18 has a residual thickness 127 in the area of the recesses 111. Further, it can be seen that the rim 120 extends from the outer side 22 up to a height 280. The thickness 180 of the plate-type element 18 thus results from the sum of the height 280 and the basic thickness 125.

The plate-type element 18 according to this embodiment comprises through-going bore holes 106 serving as fastening means.

Figure 20B:
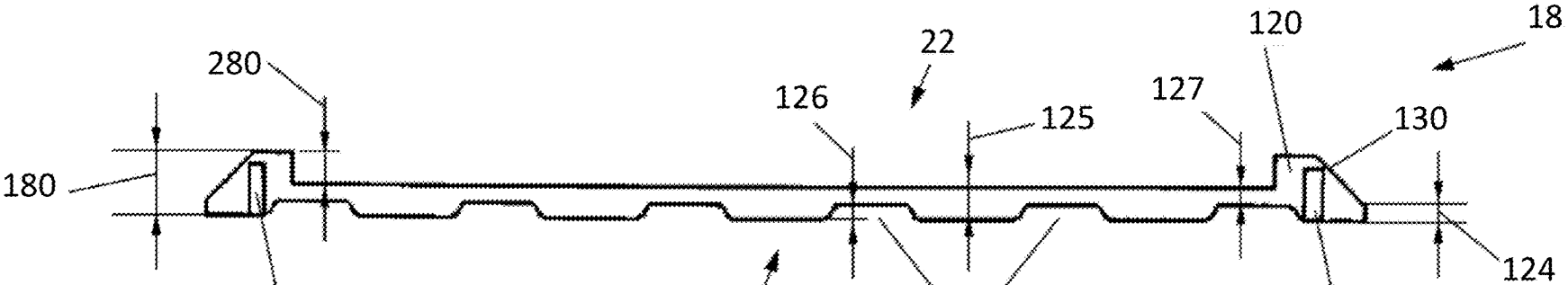

FIG. 20B schematically shows a sectional view of a plate-type element 18 according to another embodiment which essentially corresponds to that of FIG. 20A. Instead of through-going bore holes 106, the plate-type element 18 comprises blind bore holes 129 which are optionally provided in the rim 120. The blind bore holes 129 are open towards the inner side 24. Accordingly, a screw (not shown) can be screwed from the rear into the blind bore hole 129.

Figure 21:
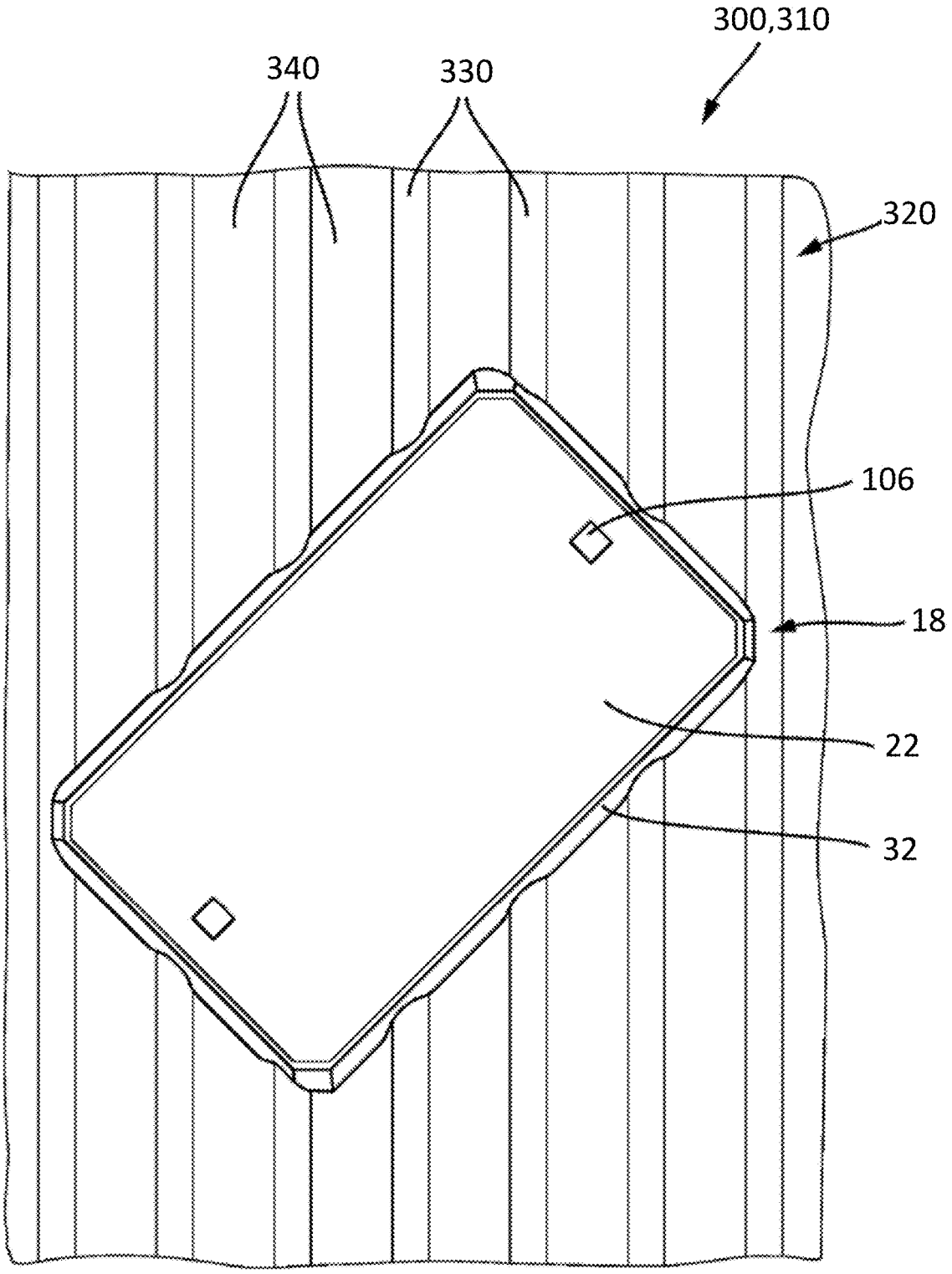

FIG. 21 is an illustration of a plate-type element 18 arranged on a grooved outer shell 310 of a grooved suitcase 300 according to the embodiment as per FIGS. 19A to 19C. The outer shell 310 of the grooved suitcase 300 has a grooved structure 320 which is constituted by parallel extending corrugations 330 spaced apart from each other and raising from a flat base area 340 of the outer shell 310.

The plate-type element 18 (see FIG. 19C) is configured correspondent to the grooved structure 320 of the grooved suitcase 300. Accordingly, the alignment of the plate-type element 18 with respect to its longitudinal extension 140, as compared to the direction of the corrugations 330, is defined by the angle 200.

Figure 22:
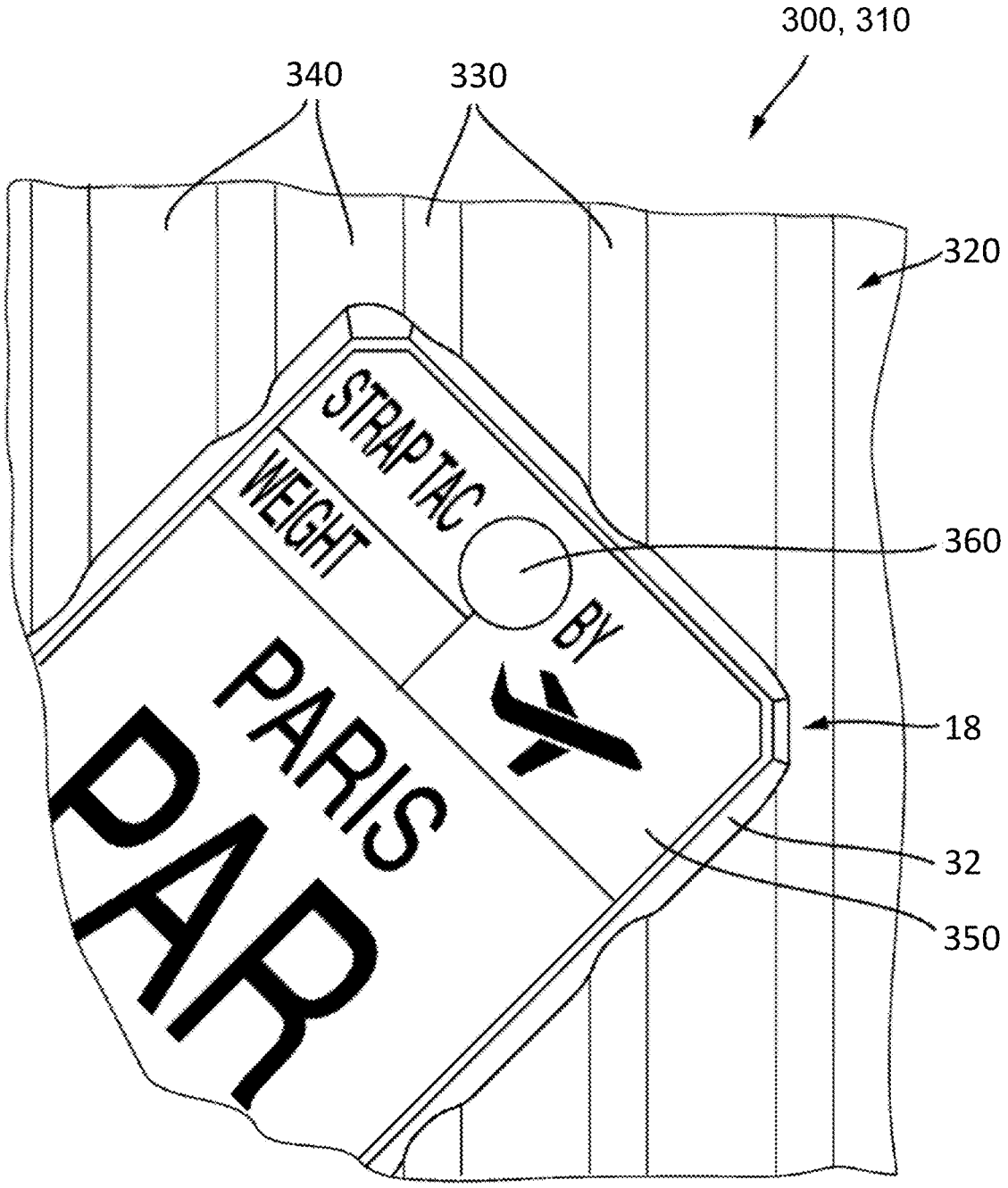

FIG. 22 is an illustration of a partial view of the plate-type element 18 of FIG. 21 to which a textile patch 350 is applied. The patch 350, together with the plate-type element 18, is fastened to the outer shell 310 by two round-head screws 360. For this purpose, one round-head screw 360 each is inserted through a corresponding opening in the patch 350 and one of the through-going bore holes 106 as well as a corresponding bore hole provided in the outer shell 310. On the inner side of the grooved suitcase 300 a nut (not shown) is screwed onto the round-head screw 360.

Further, FIG. 22 clearly shows that the patch 350 is essentially snugly received in the receiving area defined by the outer side 22 and the inner side of the rim 100.

In addition, the patch 350 can be at least partially glued to the outer side 22 of the plate-type element 18 for providing a further improved connection between the plate-type element 18 and the patch 350.

To the extent applicable, all individual features illustrated in the exemplary embodiments can be combined with each other or replace each other without departing from the scope of the invention.

The invention claimed is:

1. An item of luggage, comprising an upper and a lower side, wherein at least two luggage casters are arranged on the lower side, with the aid of which the item of luggage can be moved on a ground surface, at least two side surfaces and at least two main surfaces, wherein at least one first three-dimensional pattern is arranged on at least one of the main and/or side surfaces, wherein the first pattern comprises a plurality of first surface structures repeating in the first pattern and protruding relative to the respective main and/or side surface or recessed in the same, wherein a plate-type element is arranged on at least one main and/or side surface and connected to the main and/or side surface by at least one connecting means, wherein the plate-type element comprises at least one outer and one inner side, wherein a second pattern adapted to the first pattern is provided on the inner side, wherein the second pattern comprises at least two second three-dimensional surface structures which protrude relative to the inner side and/or are recessed in the same and are adapted to the first surface structures such that the second surface structures engage with the first surface structures, wherein the plate-type element has a thickness (D) which is thicker than the height and/or the depth of the second surface structures protruding and/or recessed relative to the inner side, wherein the first and the second surface structures of the first and the second pattern, respectively, are ribs and/or grooves.

2. The item according to claim 1, wherein the lowermost and the uppermost point, respectively, of the second three-dimensional surface structures are arranged such that they are lower and higher, respectively, by between 1 mm and 10 mm relative to the inner side.

3. The item according to claim 1, wherein the outer side of the plate-type element has an essentially flat configuration.

4. The item according to claim 1, wherein the outer side of the plate-type element comprises a circumferential edge.

5. The item according to claim 1, wherein the at least one connecting means is at least one screw connection and/or clamp connection and/or rivet connection and/or weld connection.

6. The item according to claim 1, wherein the at least one connecting means is at least one glued connection.

7. The item according to claim 1, wherein at least one seal is arranged between the main and/or side surface and the plate-type element.

8. The item according to claim 1, wherein the ribs and/or grooves configured as three-dimensional surface structures of the first and the second pattern are arranged in parallel to each other.

9. The item according to claim 1, wherein at least three surface structures are arranged on the inner side of the plate-type element.

10. The item according to claim 1, wherein the second surface structures comprise at least a number of first grooves and/or ribs extending in a first direction, and a number of second grooves and/or ribs extending in a second direction different from the first direction, wherein both the first and the second grooves and/or ribs are adapted to the first surface structures, wherein either the first grooves and/or ribs or the second grooves and/or ribs engage with the second surface structures.

11. The item according to claim 1, wherein the plate-type element comprises at least one side surface which includes an angle of more than 90° relative to the outer side.

12. The item according to claim 1, wherein at least one material, which comprises fabric, synthetic leather or metal, is applied to the outer side of the plate-type element.

13. The item according to claim 1, wherein the material can be glued to the outer side.

14. The item according to claim 1, wherein the material is arranged in a recessed manner relative to the circumferential edge of the outer side.

15. The item according to claim 1, wherein the main and/or side surfaces comprising the at least one first three-dimensional pattern comprises at least one recessed portion, wherein the plate-type element is arranged in the recessed portion on the main and/or side surface.

16. A method for producing an upcycled item of luggage having a modified main and/or side surface, comprising:

providing a first existing item of luggage having at least two side surfaces and at least two main surfaces, wherein a first three-dimensional pattern is arranged on at least one of the main and/or side surfaces, wherein the first pattern comprises a plurality of first surface structures repeating in the first pattern, which surface structures protrude relative to the respective main and/or side surface and/or are recessed in the same, producing and/or providing a plate-type element, wherein the plate-type element comprises at least one outer and one inner side, wherein a second pattern adapted to the first pattern of the first existing item of luggage and having at least two three-dimensional surface structures is provided on the inner side, which surface structures protrude relative to the inner side and/or are recessed in the same and are adapted to the first surface structures, wherein the plate-type element has a thickness which is thicker than the height and/or the depth of the second surface structures protruding and/or recessed relative to the inner side, wherein the first and the second surface structures of the first and the second pattern, respectively, are ribs and/or grooves, permanent fastening of the plate-type element to a main and/or side surface of an existing item of luggage such that the second surface structures engage with the first surface structures.

* * * * *